US006698100B2

(12) United States Patent
Yan

(10) Patent No.: US 6,698,100 B2
(45) Date of Patent: Mar. 2, 2004

(54) CONTRACTOR'S PENCIL SHARPENER MOUNTING DEVICE

(75) Inventor: Wang Yan, Downers Grove, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 10/187,138

(22) Filed: Jul. 2, 2002

(65) Prior Publication Data

US 2004/0003505 A1 Jan. 8, 2004

(51) Int. Cl.[7] ..... B43L 23/08

(52) U.S. Cl. ..... 30/298.4; 30/451; 30/459; 206/349

(58) Field of Search ..... 30/298.4, 451, 30/541, 452–462, 459; 206/371, 349

(56) References Cited

U.S. PATENT DOCUMENTS 1,969,677 A * 8/1934 Stowell
5,938,058 A * 8/1999 Kim ..... 206/255 X
6,517,480 B1 * 6/2003 Qiu ..... 30/457

* cited by examiner

*Primary Examiner*—Douglas D. Watts
(74) *Attorney, Agent, or Firm*—Banner & Witcoff, Ltd.

(57) ABSTRACT

A combination contractor's pencil sharpener and retainer includes a sharpener having a body member which is inserted through a retainer loop mounted on a plate. The plate is attached to a contractor's tool belt, tool case or the like. The sharpener is retained by a U-shaped spring member which engages against a retention flange associated with the sharpener.

6 Claims, 2 Drawing Sheets

30
22
36
34
12
50
61
154
100
60
66
64
62

CONTRACTOR'S PENCIL SHARPENER MOUNTING DEVICE

BACKGROUND OF THE INVENTION

In a principal aspect the present invention comprises to a device designed to retain a contractors pencil sharpener properly positioned for use on a tool belt or the like.

Contractors typically use a specially configured carpenter's pencil which is flat-sided and in the form of a plate. The pencil includes a broad, thick center lead section or portion which enables the contractor or user of the pencil to scribe a heavy line on items which are to be aligned, cut or otherwise require a visible mark to enable the contractor to perform a job. Such pencils must be constantly sharpened. A pencil sharpener is available that is designed especially for the sharpening of contractor's pencils. Such pencil sharpeners are of a type which include a main body member that holds a sharpening blade adjacent a passage through the body member. A pencil holder is rotatably mounted on the top of the body member and aligns a pencil in the holder appropriately with respect to the blade so that upon insertion of the pencil through the holder and into the body member, rotation of the pencil and the holder, will impinge the pencil tip against the blade retained in the body member thereby sharpening the point of the pencil. Such sharpeners are usually kept by the contractor or worker in a pocket and removed from the pocket when it is necessary to sharpen the point or tip of the pencil.

A problem that arises is obtaining easy and quick access to the sharpener. Another problem is loss of the sharpener since it is constantly being put into and removed from a pocket, tool case or the like. Thus, there has developed the problem of ease of access and retention of a contractor's pencil sharpener.

SUMMARY OF THE INVENTION

Briefly, the invention comprises a retainer for mounting a contractor's pencil sharpener and retaining the sharpener on a tool belt or the like. The retainer is utilized in combination with a pencil sharpener of the type having a body member with a lower end flange and which further includes a pencil holder portion rotatably mounted on the body member so that a pencil may be inserted into the holder and extend axially therethrough for rotation about the axis while positioning the axis or tip against a blade retained by the body member. The retainer or mounting device for the sharpener includes a circumferential loop which holds and retains the body member of the sharpener. Further, a cantilever spring clip or spring member is provided to fit over, engage and hold the flange of the pencil sharpener body member. The retainer or mounting device loop and spring member are both mounted on a triangular support plate which may be fastened to a tool belt or the like so that the sharpener and the retainer for the sharpener may be appropriately retained in an accessible position oriented for ease of use.

Thus it is an object of the invention to provide an improved contractor's pencil sharpener and retainer which may be easily incorporated or attached to a tool belt, tool case or the like.

It is a further object of the invention to provide a simple, inexpensive, yet rugged and durable retainer or mounting device for a contractor's pencil sharpener.

Another object of the invention is to provide a retainer or mounting device for receiving a contractor's pencil sharpener wherein the retainer is designed to permit attachment of the sharpener thereto as well as removal therefrom for replacement of the sharpener.

These and other objects, advantages, and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENTS

Figure 1:
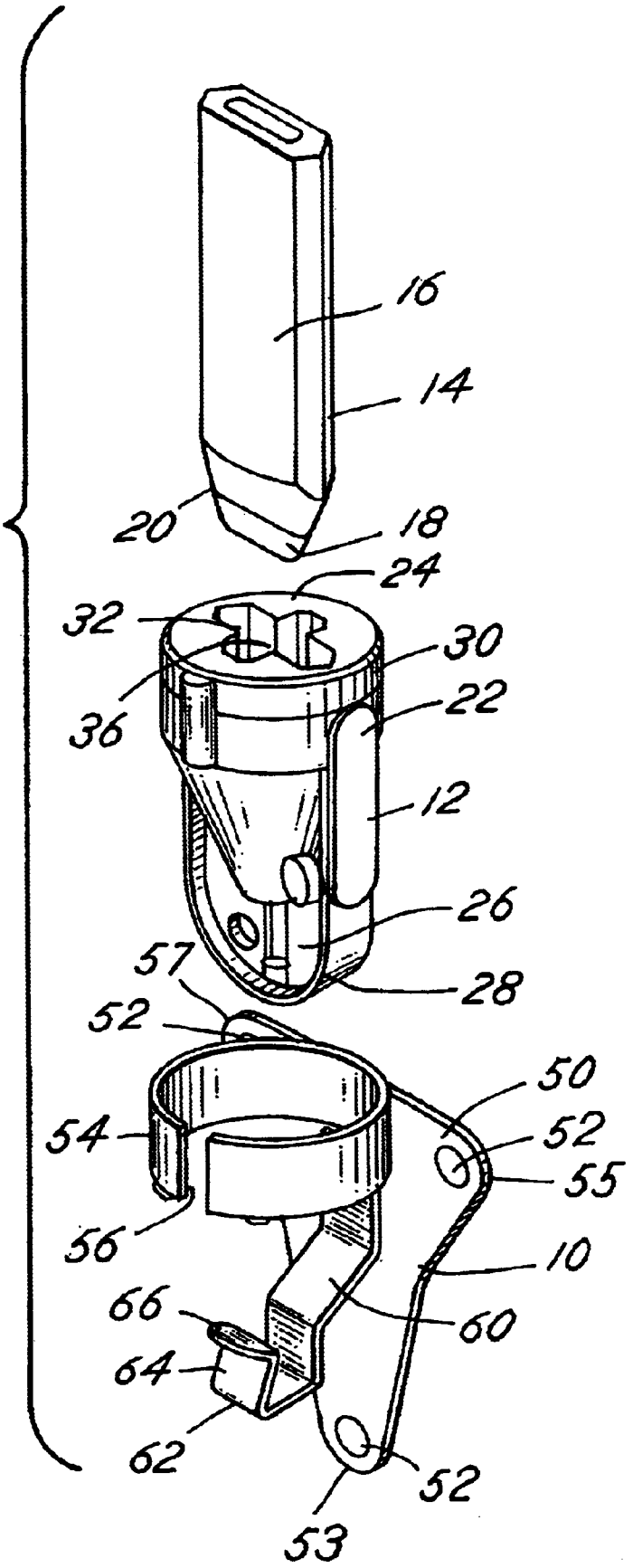
FIG. 1 is an isometric view of the component parts of the combination pencil sharpener and retainer including a view of a typical contractor's or carpenter's pencil which may be sharpened thereby.
Figure 2:
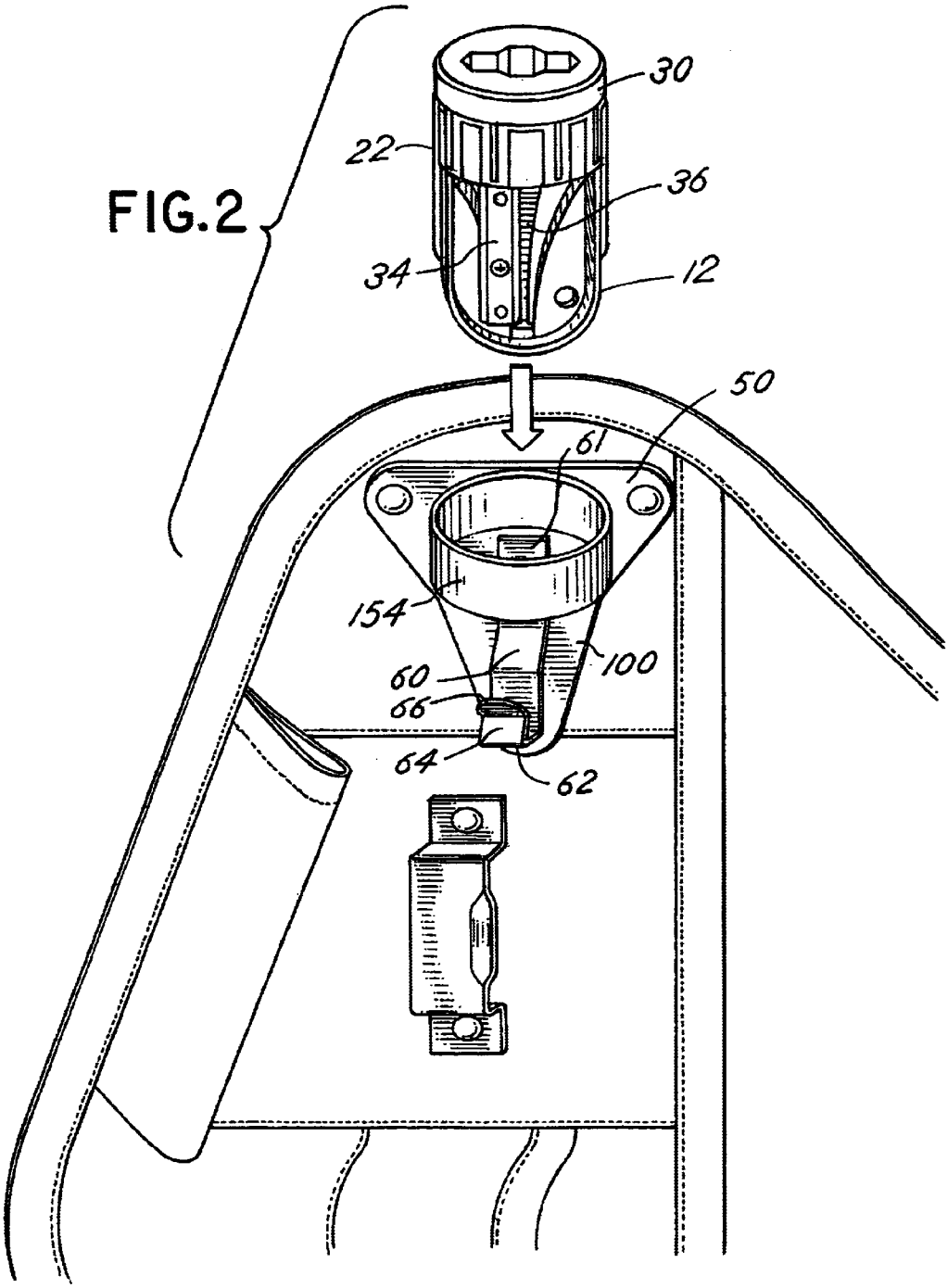
FIG. 2 is an isometric view of a second embodiment of the retainer used in combination with a pencil sharpener wherein the retainer has been attached to a tool belt.

FIGS. 1 and 2 illustrate alternative embodiments of the invention. The invention relates to the retainer 10 depicted in FIG. 1 or 100 depicted in FIG. 2 in combination with a contractor's pencil sharpener 12 in the figures. The contractors pencil sharpener 12 is designed for sharpening of a contractor's pencil 14 in FIG. 1. The contractor's pencil 14 is in the form of a flat plate with an outer, typically wooden case 16 and an inner lead 18 sharpened to form a point 20 for scribing a line.

The sharpener 12 includes a body member 22 having an access passage opening 24 which provides access to a vertical access passage 36. The body member 22 further includes a lower end 26 with an arcuate flange 28 projecting laterally from the lower end and thereby defining the bottom of the lower end 26. The body member 22 has a pencil holder 30 with a center line or axial opening 32 shaped to receive pencil 14. The opening or passage 32 extends through the pencil holder 30 and into the passage or interior 24 of the body member 22. As shown in FIG. 2, the body member 22 includes a blade 34 adjacent the interior passage 36 so that when a contractor's pencil is inserted through the pencil holder 30 and rotated, the tip 20 will engage against the blade 34 and be sharpened. Note that the passage 32 for the pencil 14 in the pencil holder 30 is configured to receive pencil configurations of various shape including the pencil or contractor's pencil 14 as depicted in FIG. 1 as well as a pencil which is made up of a generally cylindrical lead incorporated in a regular polygonal wood cladding or housing.

FIGS. 1 and 2 depict alternative embodiments of the invention. In FIG. 2, like parts have like numbers and different component parts are assigned distinct numbers.

Referring first to FIG. 1, the retainer includes a back or mounting plate 50 which is generally triangular in shape and which includes attachment rivets 52 located at each apex 53, 55, 57 of the generally rectangular plate 50. Mounted on the plate 50 is a circumferential ring or loop 54. The loop 54 in the embodiment of FIG. 1 is a circumferential loop with a gap 56 to provide some flexibility to accommodate sharpeners 12 having various dimensions and/or shapes associated with the body member 22.

Referring to FIG. 2, the retainer includes a loop 154 which is a closed loop attached to plate 50 and is designed to accommodate a fixed shape body holder as depicted in FIG. 2. The outer boundary of body member 22 is thus generally congruent with the inside of the ring or loop 154.

Referring again to FIG. 1, the retainer includes a spring metal cantilever spring catch member 60 having an upper axial end 61 attached to the plate 50 adjacent the loop 54 or 154. The axis of the retainer is generally the center axis of loop 54 when loop 54 has a cylindrical shape. The spring member 60 projects axially downwardly and includes a lower U-shaped clip 62 formed at its lower end. The clip 62 is formed to engage over the lip formed by the flange 28 of the sharpener 12. The U-shaped end 62 thus includes an upwardly and inwardly extending run 64. The end or U-shaped end 62 further includes an outwardly and upwardly extending guide run or section 66 which is provided to engage against the flange 28 as the sharpener 12 is inserted into the loop 54 or 154 to ensure that the cantilever 60 and more particularly the U-shape in 62 will be biased outwardly and then snap back and inwardly to properly engage with flange 28. The U-shaped end 62 thus defines a detent retention member or feature for retaining the sharpener 12 (i.e., flange 28) within the retainer assembly. The U-shaped end 62 of the cantilever spring member 60 is appropriately spaced axially downwardly from the loop 54 or 154 to ensure that the body member 22 is retained. The pencil holder section 30 must, however, remain rotatable within the loop 54 or 154 or projecting above the loop 54 or 154.

The retainer is typically attached by means of the rivets 52 as shown in FIG. 2 to a tool belt, tool case, or the like. Thus the sharpener 12 may be easily accessed by a worker, carpenter, contractor, or the like. The sharpener 12 may also be easily replaced and removed for repair. The combination of the sharpener and mounting device enables the contractor to have easy access to the sharpener without constantly attempting to search pockets, a tool case or the like.

It is noted that various alternative constructions may be utilized and various materials may be utilized for the manufacture of the retainer. In a preferred embodiment the retainer is made from metal components that are welded or otherwise fastened together. However, the device may be made from various molded plastic materials. Additionally the loop 54 or 154 may be configured in various ways and may be an open loop 54 or a closed loop 154. The spring member 60 may be shortened and attached toward the lower end of the plate 10. Various other modifications of the invention may be made without departing from the spirit and scope thereof. The invention is therefore limited only by the following claims and equivalents thereof.

What is claimed is:

1. A combination contractor's pencil sharpener and retainer comprising, in combination:

a contractor's pencil sharpener of the type including a main body member having a longitudinal axis, a lower end with a flange generally transverse to the axis, an upper end with an axial bore, a blade intermediate the lower end and upper end, a pencil holder rotatably mounted on the upper end and including an axial passage for receipt of the point end of a contractor's pencil to engage said blade on rotation of the pencil holder to sharpen the point end of the pencil in the holder; said upper end having an outer boundary; and a retainer for receiving the sharpener and retaining the sharpener in a fixed, attached nonrotatable configuration, said retainer including:

(a) a generally planar vertically mountable plate having an upper end and a lower end;

(b) a generally closed loop ring mounted on the plate at the upper end congruent with the outer boundary of the sharpener body member for slidable receipt and retention of the body member; and (c) a cantilever spring catch member in the form of a longitudinal band having a first end attached to the plate and projecting axially from adjacent the closed loop ring to a u-shaped clip formed said clip having an open side projecting axially toward the first end said and clip defining a detent retention member for releasably engaging the body member lower end flange, whereby a carpenter's pencil may be inserted into the body member and rotated about the axis to engage the lead against the blade to sharpen the pencil.

2. The combination of claim 1 wherein the plate is mounted on a carrier selected from the group consisting of a tool belt, a tool case, a tool organizer, and a backing member.

3. The combination of claim 2 wherein the plate is generally triangular in shape with a fastener located at each apex of the plate for attachment to the carrier.

4. The combination of claim 1 wherein the closed loop ring is circular.

5. The combination of claim 4 wherein the ring is discontinuous and comprises first and second arcuate sections.

6. The combination of claim 1 wherein the U-shaped clip includes an end section inclined outwardly from the axis for engaging and directing the sharpener flange into a detent position.

* * * * *